US005609730A

United States Patent [19]

Shimooka et al.

[11] Patent Number: 5,609,730

[45] Date of Patent: Mar. 11, 1997

[54] METHOD OF OPERATING DRY QUENCHING APPARATUS FOR HOT COKE

[75] Inventors: Takeshi Shimooka; Isamu Minamisawa; Kosaku Sunouchi; Michitake Takahashi, all of Ibaraki-ken, Japan

[73] Assignee: Sumitomo Metal Industries, Ltd., Osaka, Japan

[21] Appl. No.: 360,123

[22] Filed: Dec. 20, 1994

Related U.S. Application Data

[63] Continuation of Ser. No. 7,019, Jan. 21, 1993, abandoned, which is a continuation of Ser. No. 865,650, Apr. 10, 1992, abandoned, which is a continuation of Ser. No. 611,782, Nov. 13, 1990, abandoned.

[30] Foreign Application Priority Data

Nov. 14, 1989 [JP] Japan ..... 1-296867
Nov. 14, 1989 [JP] Japan ..... 1-296870

[51] Int. Cl.[6] ..... C10B 1/00; G05B 13/00

[52] U.S. Cl. ..... 201/1; 201/39

[58] Field of Search ..... 201/1, 39; 202/151, 202/95, 227

[56] References Cited

U.S. PATENT DOCUMENTS 4,076,593 2/1978 Koizumi et al. ..... 201/39

FOREIGN PATENT DOCUMENTS 155490 9/1984 Japan ..... 201/1
182884 10/1984 Japan ..... 201/1
236887 10/1987 Japan ..... 201/1
63-314294 12/1988 Japan .
63-308091 12/1988 Japan .
314294 12/1988 Japan ..... 201/1
308091 12/1988 Japan ..... 201/1
2130746 6/1984 United Kingdom ..... 201/1

OTHER PUBLICATIONS

*The Encyclopedia Americana,* International Edition, vol. 7, 1986, p. 214.

I. Minamisawa et al., "Development of Optimal Automatic Control CDQ System", *The Sumitomo Search No. 42,* pp.40–47 (Apr. 1990).

*Primary Examiner*—Virginia Manoharan

*Attorney, Agent, or Firm*—Burns, Doane, Swecker & Mathis, LLP

[57] ABSTRACT

A dry quenching apparatus for hot coke is operated by collecting data on preceding operations. The heat balance is calculated based on the collected data to determine the heat content of the charged hot coke, and an optimal operating schedule is calculated based on the calculated heat content. Optimal operating conditions are calculated based on the optimal operating schedule, and the dry quenching apparatus is operated in accordance with the optimal operating conditions.

9 Claims, 6 Drawing Sheets

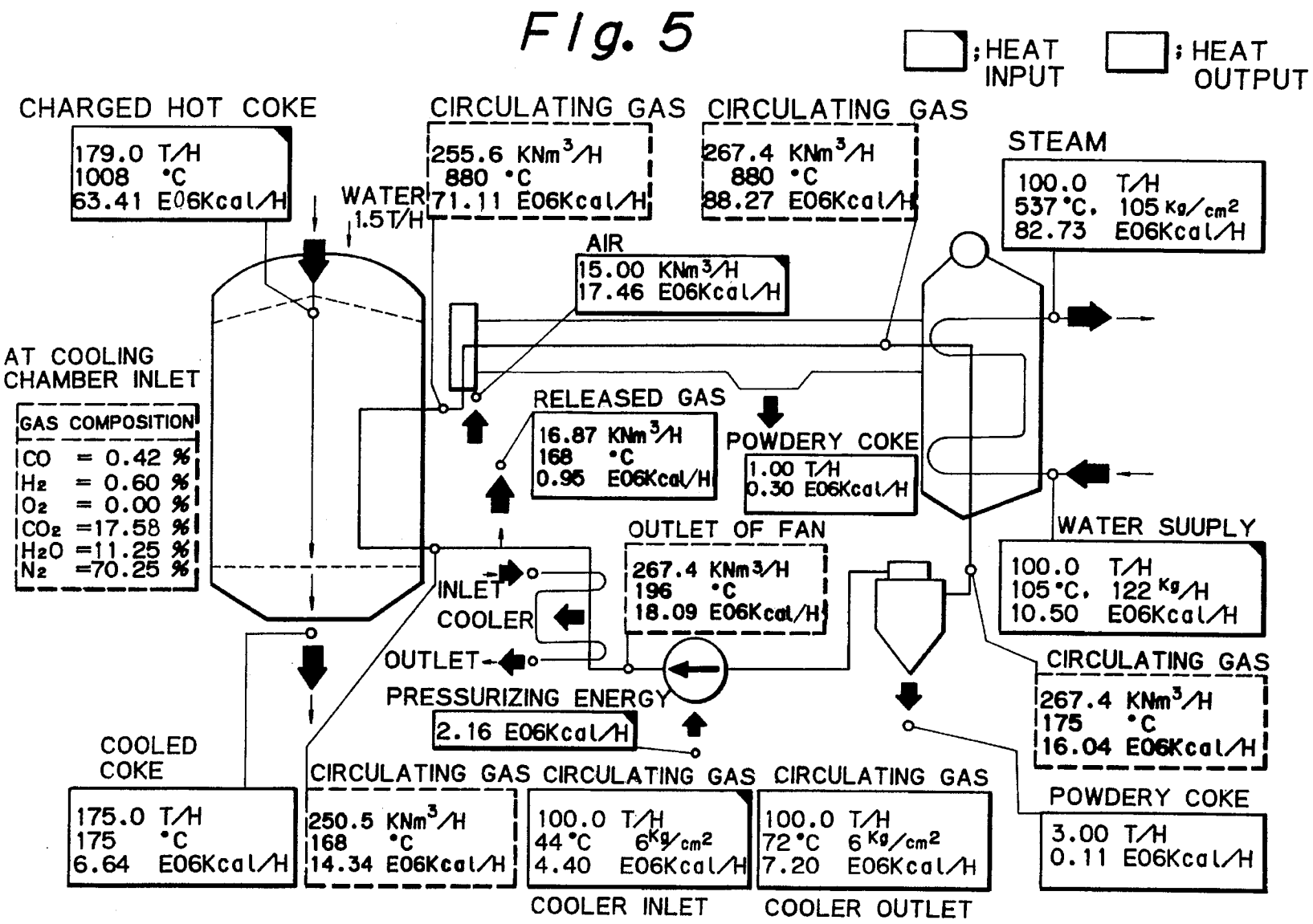
Fig. 5
: HEAT INPUT
: HEAT OUTPUT
STEAM
100.0 T/H
537 °C, 105 Kg/cm²
82.73 E06Kcal/H
WATER SUUPLY
100.0 T/H
105 °C, 122 Kg/H
10.50 E06Kcal/H
CIRCULATING GAS
267.4 KNm³/H
175 °C
16.04 E06Kcal/H
POWDERY COKE
3.00 T/H
0.11 E06Kcal/H
CIRCULATING GAS
267.4 KNm³/H
880 °C
88.27 E06Kcal/H
CIRCULATING GAS
255.6 KNm³/H
880 °C
71.11 E06Kcal/H
AIR
15.00 KNm³/H
17.46 E06Kcal/H
POWDERY COKE
1.00 T/H
0.30 E06Kcal/H
RELEASED GAS
16.87 KNm³/H
168 °C
0.95 E06Kcal/H
OUTLET OF FAN
267.4 KNm³/H
196 °C
18.09 E06Kcal/H
PRESSURIZING ENERGY
2.16 E06Kcal/H
INLET
COOLER
OUTLET
WATER
1.5 T/H
CHARGED HOT COKE
179.0 T/H
1008 °C
63.41 E06Kcal/H
AT COOLING CHAMBER INLET
GAS COMPOSITION
CO = 0.42 %
H₂ = 0.60 %
O₂ = 0.00 %
CO₂ = 17.58 %
H₂O = 11.25 %
N₂ = 70.25 %
COOLED COKE
175.0 T/H
175 °C
6.64 E06Kcal/H
CIRCULATING GAS
250.5 KNm³/H
168 °C
14.34 E06Kcal/H
CIRCULATING GAS
100.0 T/H
44 °C 6 Kg/cm²
4.40 E06Kcal/H
COOLER INLET
CIRCULATING GAS
100.0 T/H
72 °C 6 Kg/cm²
7.20 E06Kcal/H
COOLER OUTLET

METHOD OF OPERATING DRY QUENCHING APPARATUS FOR HOT COKE

This application is a continuation of application Ser. No. 08/007,019, filed Jan. 21, 1993, abandoned which is a continuation of application Ser. No. 07/865,650 filed Apr. 10, 1992, abandoned a continuation of application Ser. No. 07/611,782 filed Nov. 13, 1990.

BACKGROUND OF THE INVENTION

The present invention relates to a method of operating a dry quenching apparatus for hot coke, and particularly to a method of operating the apparatus under optimal conditions for maximum benefits.

In a conventional coke oven, hot coke which has been pushed out of the oven is quenched with a water spray. This quenching process is referred to as wet quenching. Wet quenching has the disadvantages that a very large amount of heat of the hot coke is wasted by release into the air and that steam which is produced during water-quenching is accompanied by dust, which is dispersed into the environment.

Therefore, dry quenching apparatuses (hereunder also referred to as "coke dry quenchers(CDQ)") have recently been employed. A dry quenching apparatus can not only recover sensible heat of hot coke but can also prevent the spread of dust. In addition, it can increase the strength and lower the water content of the coke.

Furthermore, a dry quenching apparatus has the advantage that combustible gases such as methane, hydrogen, and carbon monoxide which are contained in the hot coke and monoxide gas which is produced by combustion of coke can be recovered.

However, it has also the disadvantage that during dry quenching, powdering and combustion of the coke are inevitable, resulting in a decrease in the yield of coke.

A conventional dry quenching apparatus for hot coke has a capacity of 30–50 tons/hour. A plurality of dry quenching apparatuses must be provided for one coke oven battery. Recently a large-scale dry quenching apparatus with a capacity of 100–200 tons/hour has been employed since it is economical to construct and easy to operate. A single dry quenching apparatus of this size can treat the output of an entire battery of coke ovens.

An arrangement of coke oven batteries and coke dry quenchers (CDQ) of this type in which each coke oven battery is associated with one quenching apparatus having a large capacity is shown in FIG. 1. Hot coke from battery A is supplied to CDQ No. 2 and that from battery B is supplied to CDQ No. 1.

FIG. 2 is a schematic partially sectional view of a dry quenching apparatus for hot coke. Hot coke discharged from a coke oven is loaded into a coke bucket 1 disposed on a bucket car and then lifted by a winch 2 to the top of a quenching tower 3, i.e., a CDQ. The hot coke is then charged into a prechamber 4 through the bucket 1' lifted to the top of the quenching tower 3.

After being charged into the prechamber 4, the hot coke descends within a cooling chamber 5 while being cooled by contact with an inert gas such as nitrogen gas which is blown into the cooling chamber 5 through a blast head 7 by a gas circulating fan 6. After it is cooled, the coke is discharged from the quenching tower 3 by means of a discharge device 8. A circulating gas which is heated by contact with the hot coke is subjected to dusting in a waste gas flue 9 and then is passed into a heat exchanger 10. After passing through the heat exchanger 10, the cooled gas is subjected to dusting with a plurality of cyclone separators 11 and is blown into the cooling chamber 5 with the fan 6 for re-use as a cooling gas. High-temperature, high-pressure steam which is recovered from the heat exchanger 10 is supplied to an apparatus employing steam, such as a turbo-generator (not shown).

In a quenching apparatus of this type, the discharge rate of cooled coke is determined so as to maintain a given level of hot coke within the prechamber 4.

Since discharging of hot coke from the coke oven is carried out intermittently, hot coke from the oven is charged into the prechamber 4 at intervals of 7–9 minutes. However, hot coke is not charged into the prechamber 4 at all during the period that the coke oven is running (1–2 hours).

Thus, the delivery rate of cooled coke through the discharge device 8 is controlled so that the level of hot coke within the prechamber 4 reaches the highest level when the discharge of hot coke from the coke oven and the charging of hot coke into the prechamber 4 are finished.

Therefore, the delivery rate of coke through the discharge device 8 is adjusted so that the level within the prechamber 4 reaches a minimum level when the next discharge of hot coke from the coke oven is started. In addition, combustible components combined with the circulating gas may be combusted by introducing oxygen gas into the flue 9 so that fluctuation in the amount of recovered steam is minimized while fluctuation in the discharge rate of cooled coke is minimized.

However, when the prechamber 4 is large enough to treat all the coke which is discharged from an entire coke oven battery at one time, the discharge rate of cooled coke cannot be adjusted to be the same each time.

Namely, in the case of a large-scale prechamber 4, during the period when discharging from the coke oven is being carried out the delivery rate of cooled coke through the discharge device 8 is increased, and during the period when charging of hot coke into the prechamber 4 is being stopped the delivery rate of cooled coke through the discharge device 8 is decreased. It is inevitable that the amount of steam recovered varies depending on whether the hot coke is being discharged from the coke oven or not.

When hot coke cannot be discharged from the coke oven due to a problem such as the breakdown of a pusher, the metering of coke through the discharge device 8 is adjusted depending on the level of coke within the prechamber 4.

In the worst case, as shown in FIG. 3, in which a problem occurs during discharging of hot coke from Battery A into a coke dry quencher, the discharging is stopped and the level of coke within the prechamber 4 falls below the lower limit. In that case, the removal of coke as well as circulation of the cooling gas are also stopped, and as a result, the recovery of steam is stopped.

In contrast, when the removal of cooled coke is stopped due to a problem in the discharge device 8, such as a belt-conveyor, or the like, charging of hot coke into the prechamber 4 is continued while the level within the prechamber 4 is observed. It is necessary that charging be stopped temporarily when the level in the prechamber 4 reaches the upper limit, that coke quenching be continued by switching to water-quenching, i.e., wet quenching, or that the hot coke be charged into another dry quenching apparatus for hot coke.

The problems of controlling the operation of a dry quenching apparatus become serious especially when an arrangement of batteries of coke ovens and dry quenching apparatuses like that shown in FIG. 1 is employed.

Recently, a method has been proposed to eliminate such problems. According to this new method it is possible to operate a coke dry quenching apparatus in a stable manner on a real time basis so as to optimize the operating conditions. The method comprises pre-calculating the amount of sensible heat of hot coke when discharged from an oven and the amount of combustible components of the gas on the basis of data on dry carbonization conditions and the amount and composition of starting coal, calculating the material balance and the heat balance of the dry quenching apparatus to form optimum operational data, and controlling the discharging of coke and the operation of the quenching apparatus on the basis of the optimum operational data. See Japanese Unexamined Patent Application Publication No. 63-308091/1988. However, in this method, a difference between the calculated data and the characteristics of the hot coke actually charged into the quenching apparatus is inevitable, mainly because the precalculation is carried out using data on dry carbonization and starting coal.

SUMMARY OF THE INVENTION

An object of the present invention is to provide a method of operating a dry quenching apparatus for hot coke which is free from the above-mentioned disadvantages.

Another object of the present invention is to provide a method of operating a dry quenching apparatus in a stable manner under optimal conditions so as, for example, to maximize the generation of steam and recovery of combustible gases.

Still another object of the present invention is to provide a method of operating a dry quenching apparatus for hot coke in such a manner as to minimize fluctuation in the discharge rate of cooled coke through the discharge device as well as the recovery of steam from a heat exchanging apparatus even when problems occur while discharging hot coke from the coke oven or charging hot coke into the quenching apparatus or discharging cooled coke from it.

According to the present invention, first the data on the preceding operations necessary to calculate the heat balance are collected from sensors provided in various locations of the quenching apparatus. The heat balance for an overall hot coke quenching system including a dry quenching apparatus and a heat exchanging apparatus is calculated on the basis of this data. Calculation of the heat balance is carried out in sequence from the heat exchanging apparatus to the hot coke dry quenching apparatus in order to determine the temperature of the hot coke charged into the prechamber and the composition and amount of combustible gases contained in the charged hot coke. Namely, the calculation is carried out so as to determine the total heat content of the charged hot coke. It is desirable that the determined temperature of the charged hot coke and the composition and amount of combustible gases such as hydrogen gas and carbon monoxide gas be adjusted based on data from preceding operations of the coke dry quenching apparatus.

Therefore, it is possible to obtain precise data on the temperature of charged hot coke, and the composition and amount of combustible gases contained in the charged hot coke.

According to the before-mentioned prior art method using a CDQ with a large capacity, the amount of sensible heat and the amount of combustible components of the hot coke are calculated on the basis of data on dry carbonization conditions and the amount and composition of starting coal. It is also to be noted that direct measurements of the temperature of charged hot coke and the composition and amount of combustible gaseous components cannot give data that is adequately precise for the purpose of the present invention.

On the basis of the results of the calculation an optimal operating schedule (scheme data) is calculated to determine, for example, an optimal blow rate of a cooling gas as well as an optimal discharge rate of cooled coke and an optimal water supply rate to a boiler.

According to the present invention, such an optimal operating schedule is further adjusted to be one with maximum benefits by taking into consideration running costs, i.e., service and utility costs such as gas blowing costs, water supply costs, and labor costs.

Thus, the present invention resides in a method of operating a dry quenching apparatus for hot coke comprising:

collecting data preferably on the preceding operations including, for example, the amount, temperature, and pressure of steam recovered, and the amount, temperature, and pressure of water supplied to a boiler, temperatures of circulating gas at an inlet and outlet of a boiler, the amount of recovered powdery coke, the amount of air blown, temperatures of circulating gas at an inlet and outlet of a cooling chamber, temperature and amount of the coke removed from the chamber;

calculating the heat balance for a overall hot coke quenching system on the basis of the collected data, preferably those on the preceding operations to determine the temperature of the hot coke charged and the composition and amount of combustible gases remaining in the charged hot coke when the hot coke is charged into the dry quenching apparatus;

calculating on the basis of the results of this calculation an optimal operating schedule including, for example, the blow rate of cooling gas, the water supply rate to the boiler, and the discharge rate of cooled coke;

further calculating on the basis of the optimal operating schedule and service and utility costs, such as costs of gas blowing and water supply, optimal operating conditions under which maximum advantages can be obtained; and operating the dry quenching apparatus in accordance with the optimal operating conditions.

According to the present invention, the dry quenching apparatus is operated on the basis of the above-calculated optimal operating conditions so that maximum benefits can be obtained.

In a preferred embodiment, the present invention may also be applied to a coke producing system in which one dry quenching apparatus for hot coke is provided for one battery of coke ovens.

In another preferred embodiment, the present invention may be applied to a coke producing system in which one dry quenching apparatus is provided for a plurality of batteries of coke ovens and hot coke is charged into the quenching apparatus from any one of these batteries.

Usually a plurality of coke oven batteries are provided in series and a plurality of dry quenching apparatuses are provided for each battery of coke ovens. However, as mentioned before, since the capacity of a newly-constructed dry quenching apparatus may be large enough to accept all the hot coke discharged from an entire battery of coke ovens, one dry quenching apparatus with a capacity of 100 tons/hour or larger can be provided for each battery of coke ovens. Therefore, when charging of hot coke into a dry quenching apparatus from one battery of ovens is stopped, coke must be charged from another battery.

Therefore, in another aspect, the present invention is a method of operating a hot coke dry quenching apparatus in a production line comprising a plurality of batteries of coke ovens in series and at least one hot coke dry quenching apparatus, the method comprising, when trouble occurs with one battery of coke ovens from which hot coke is being discharged, calculating how much hot coke is to be discharged from another battery of coke ovens into a prechamber of the quenching apparatus on the basis of data on the amount of coke in the prechamber and the discharge rate of cooled coke through the discharge device so that the level of coke will not descend below the lower limit and so that the discharge rate of cooled coke through the discharge device will not fluctuate, and charging the calculated amount of hot coke from another battery of coke ovens into the dry quenching apparatus.

The calculation of the amount of hot coke to be charged from another battery of coke ovens can be carried out as described above to maximize the benefits of the hot coke quenching process.

BRIEF DESCRIPTION OF THE DRAWINGS

FIG. 5 is a flow diagram showing results of calculation of heat balance in accordance with the present invention;

DESCRIPTION OF THE PREFERRED EMBODIMENTS

The present invention will now be described in detail with reference to the accompanying drawings, FIG. 4 of which shows an example of the control system of the present invention.

Figure 4:
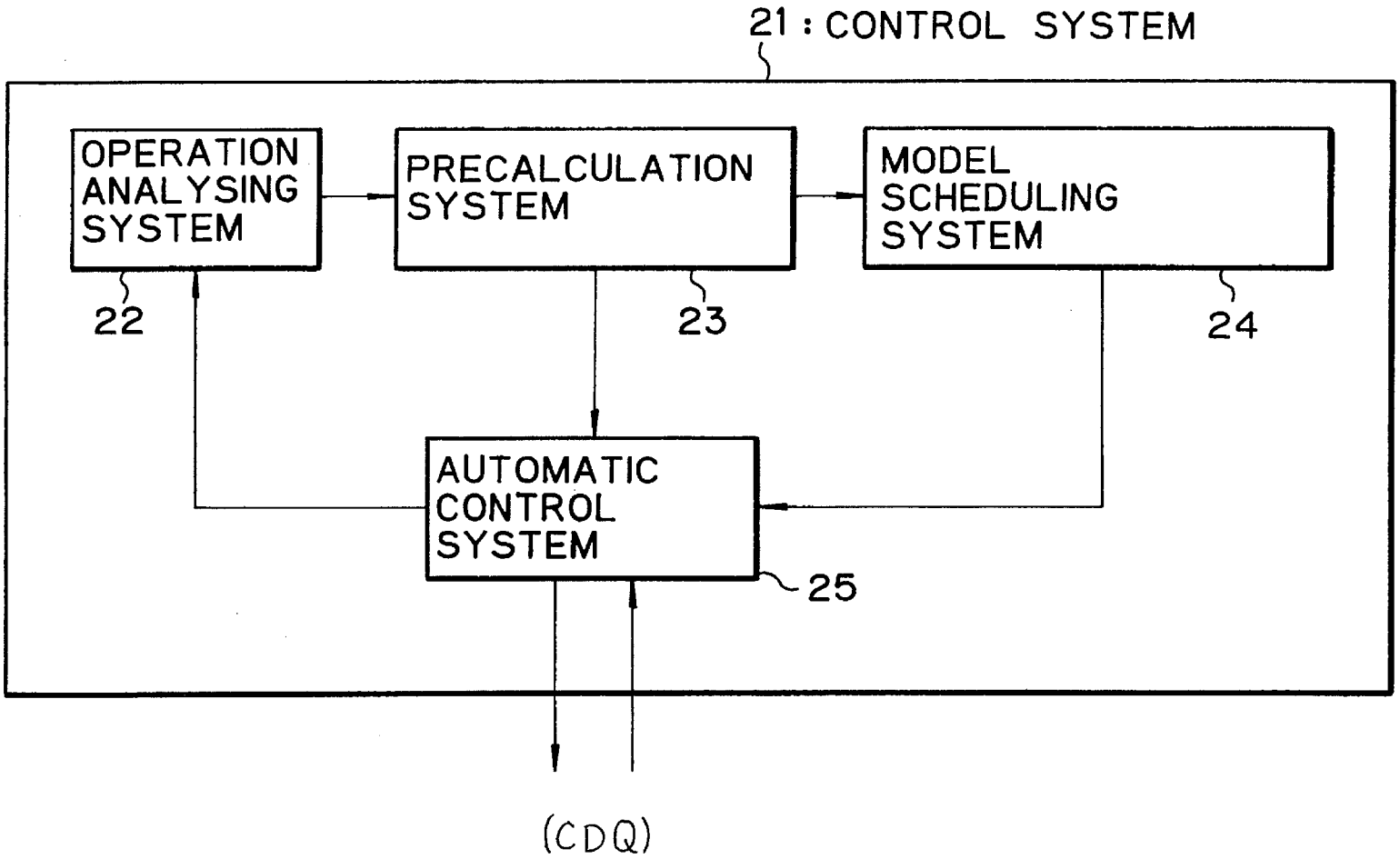
FIG. 4 is an illustration of a control system employed in the present invention.

In FIG. 4, a control system 21 comprises an operation-analyzing system 22, a precalculation system 23 for calculating an optimal operating schedule, a model-scheduling system 24, i.e., a system for calculating optimal operating conditions, and an automatic control system 25 for controlling a dry quenching apparatus for hot coke.

Operation-analyzing system

Data on the preceding operations are collected and supplied to the operation-analyzing system 22. The collected data preferably include operational data obtained from preceding operations including the amount, temperature, and pressure of steam recovered, and the amount, temperature, and pressure of water supplied to a boiler, temperatures of a circulating gas at the inlet and outlet of a boiler, the amount of recovered powdery coke, the amount of air blown, temperatures of a circulating gas at an inlet and outlet of a cooling chamber, the temperature and amount of discharged cooled coke, the amount of charged hot coke, composition of the circulating gas, and the like.

On the basis of these operational data the overall heat balance for a hot coke quenching system can be calculated, preferably in a sequential manner from a heat exchanging apparatus to a coke dry quenching apparatus so as to determine the temperature of the charged hot coke and the composition and amount of combustible gases contained in the charged hot coke.

In a preferred embodiment, the heat balance of the hot coke quenching system including a heat exchanging apparatus and a cooling chamber can be calculated based on data on the preceding operations, and preferably data on the preceding 8 hours operations.

Namely, the temperature of charged hot coke, and the composition and amount of combustible gaseous components remaining in the charged hot coke can be calculated based on the heat input and output of the CDQ. In other words, when hot coke is charged into a coke dry quencher, the heat balance therefor will shift to an extent from the preceding heat balance, and on the basis of this shift the temperature of the charged hot coke and the composition and amount of combustible gaseous components of the hot coke can be calculated.

An example of results of calculation is shown in FIG. 5. Based on these data the heat balance can be calculated and the temperature of the charged hot coke and the composition and amount of gaseous components of the hot coke can be determined.

Precalculation System

The results of the calculations by the operation-analyzing system 22 including data on the temperature of the charged hot coke and the composition and amount of gaseous combustible components remaining in the charged hot coke are input to the precalculation system 23 for calculating an optimal operating schedule including, for example, the blow rate of a circulating cooling gas, the amount of the cooled coke to be discharged, and the maximum permissible amount of air for combustion. Also, the amount of steam recovered and the inlet temperature of a boiler can be calculated. This calculation can be done using a simulation model.

Model Scheduling System

On the basis of the results of the calculations by the precalculation system and unit prices, i.e., service and utility costs, the optimal operating conditions for maximum benefits can be calculated in the model-scheduling system 24. The amount of steam to be recovered and the costs of services including the energy cost used, for example, may be taken into consideration when such calculation is carried out.

Automatic Control System

The results are output to operate the dry quenching apparatus through the automatic control system 25.

It is possible to automatically operate the dry quenching apparatus by providing the above-determined optimal operating conditions to the automatic control system 25.

Figure 6:
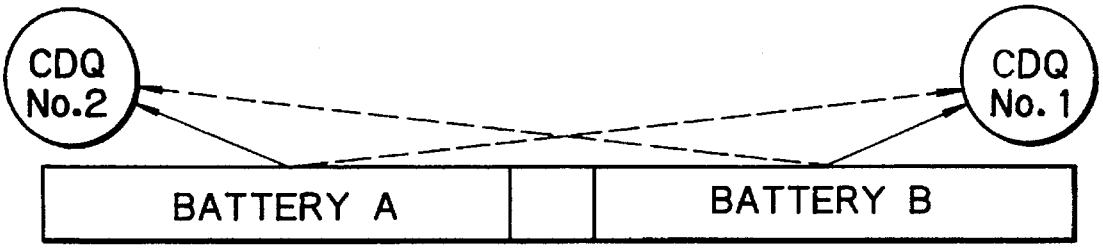
FIG. 6 shows an example of an arrangement of coke oven batteries and dry quenching apparatuses to which the control system of the present invention can be applied.

FIG. 6 shows an example of a control system to which the present invention may be applied. In FIG. 6, hot coke may be supplied from either of Batteries A or B into CDQ No.1 or CDQ No.2. In this arrangement, the same hot coke conveying system (not shown) may be used for both batteries, and it is easy to switch one battery of coke ovens or one dry quenching apparatus to another one when a problem occurs in either battery or dry quencher.

The present invention will be further described in conjunction with working examples, which are presented merely for illustrative purposes and in no way restrict the present invention.

EXAMPLE 1

Figure 1:
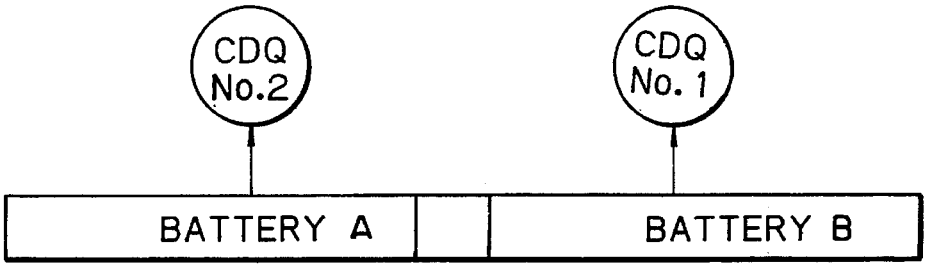
FIG. 1 shows an example of an arrangement of coke oven batteries and dry quenching apparatuses for hot coke.
Figure 2:
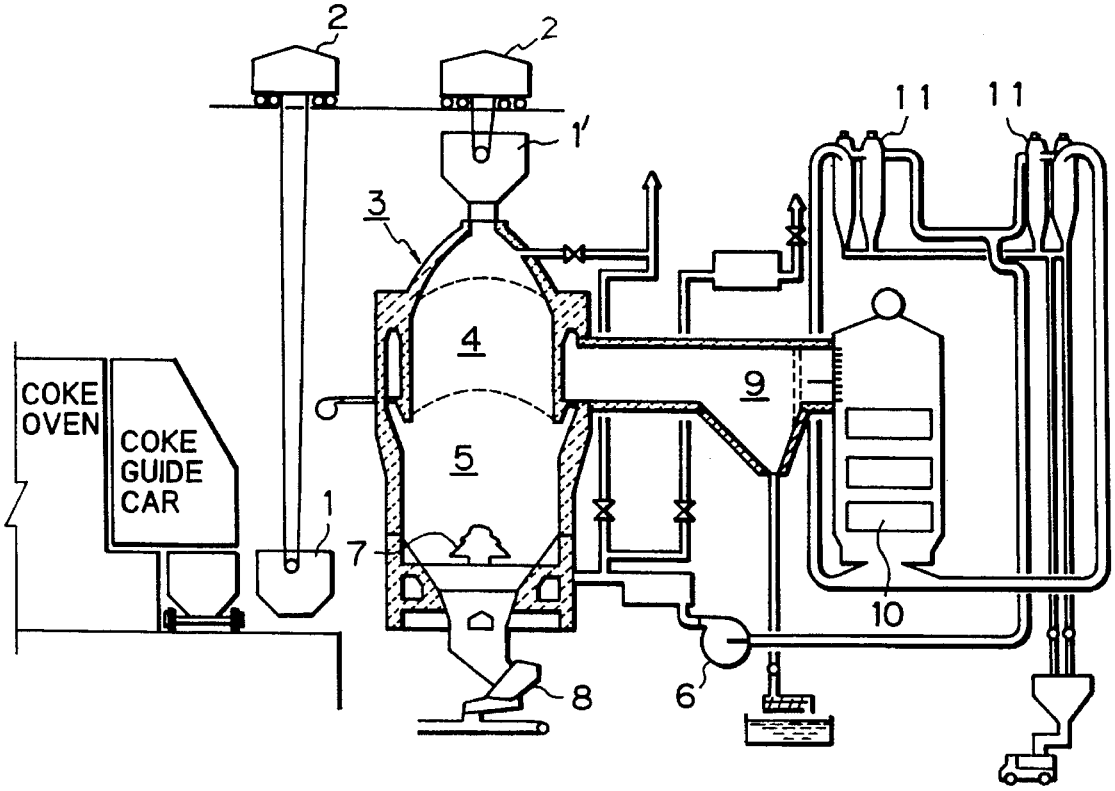
FIG. 2 is a schematic illustration of a dry quenching apparatus for hot coke.

In this example, the dry quencher shown in FIG. 1 was used to carry out the method of the present invention. The operating control system was that shown in FIG. 4.

The results of calculation of heat balance are shown in FIG. 5.

Figure 7:
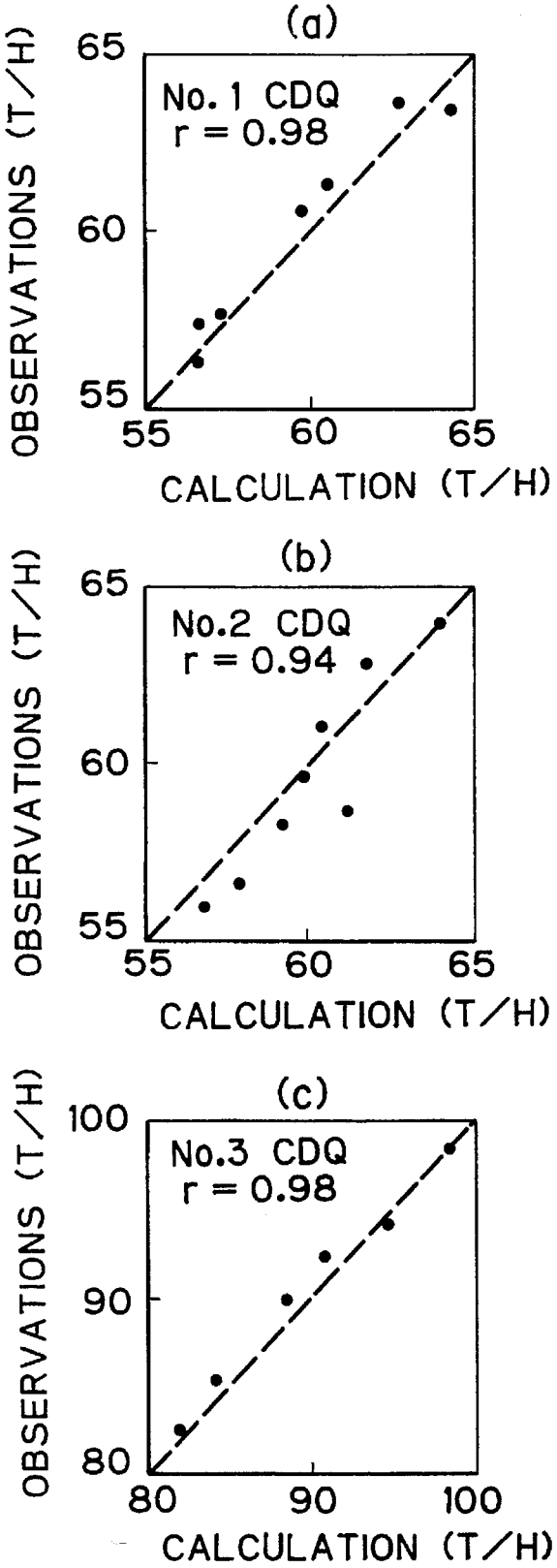
FIGS. 7*a*, 7*b*, and 7*c* are graphs showing the results of calculations compared with the results of real operation.

FIGS. 7*a*, 7*b*, and 7*c* show calculated optimal operating conditions in comparison with operating data obtained in actual operations.

FIG. 7*a* shows the case in which the coke treating capacity was 134 tons/hour and the boiler capacity was 65 tons/hour. The amount (tons/hour) of steam recovered was estimated with an accuracy of 0.98.

FIG. 7*b* shows the case in which the coke treating capacity was 150 tons/hour and the boiler capacity was 65 tons/hour. The amount of steam recovered was estimated with an accuracy of 0.94.

FIG. 7*c* shows the case in which the coke treating capacity was 196 tons/hour and the boiler capacity was 100 tons/hour. The amount of steam recovered was estimated with an accuracy of 0.98.

These results indicate that according to the present invention, the temperature of hot coke charged into the prechamber and the composition and amount of combustible gaseous components remaining in the hot coke can be determined on a real time basis.

EXAMPLE 2

In case of breakdown of a pusher, for example, there is a possibility that the level of coke will fall below a prescribed lower limit. Therefore, it is necessary to charge hot coke from another coke oven battery and to calculate how much hot coke is to be charged from the coke oven battery with a minimum of fluctuation in the discharge rate of cooled coke.

As shown in FIG. 6, two batteries of coke ovens having a height of 7125 mm were provided in series and one quenching apparatus such as shown in FIG. 1 was provided for each battery of coke ovens. Battery A comprised 92 coke ovens and battery B comprised 87 coke ovens.

Figure 3:
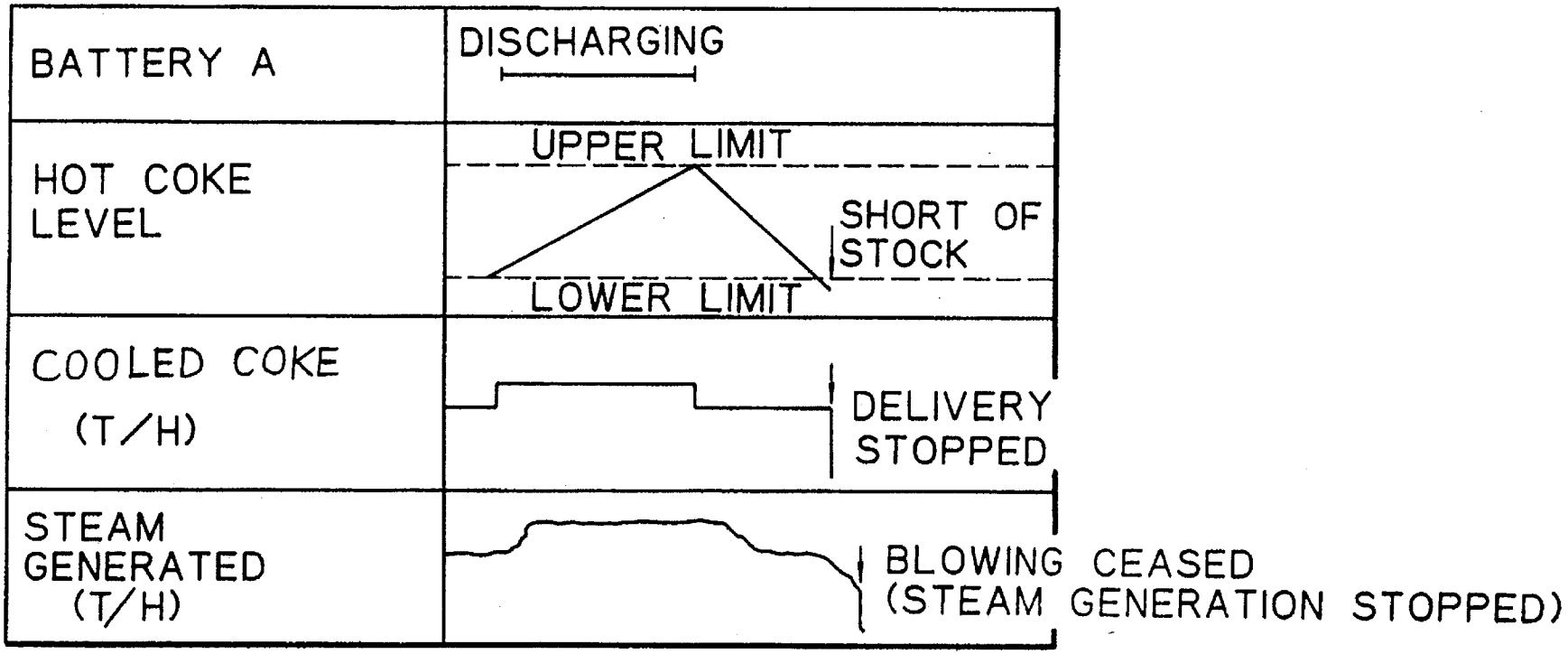
FIG. 3 is a diagram which explains changes in the coke level within a prechamber, the amount of the coke delivered from a cooling chamber, and the amount of steam produced when a problem occurs in a conventional coke oven during discharging of hot coke.

For comparison the dry quenching apparatus was operated without using the method of the present invention. When a problem occurred, the removal of coke and generation of steam were stopped as shown in FIG. 3.

Figure 8:
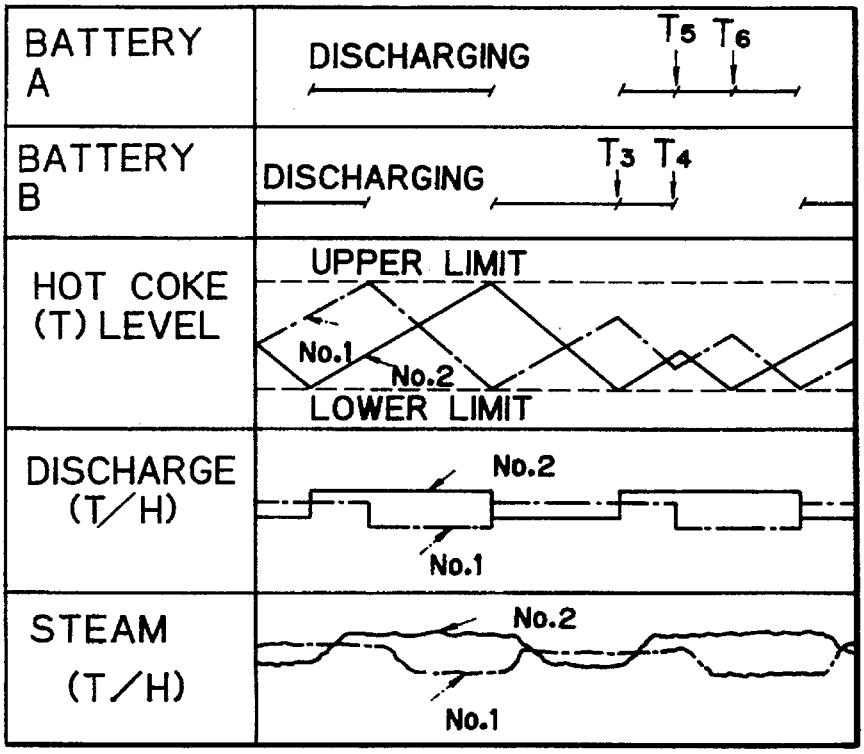
FIG. 8 is a graph showing the results of an example of the present invention.

The method of the present invention was used to operate the quenching apparatus when trouble occurred in discharging hot coke from Battery B at time T3–T4 as shown in FIG. 8. Namely, the necessary amount of hot coke to keep the coke level within the prechamber above a lower limit and to minimize fluctuation in the removal rate of cooled coke was calculated. On the basis of the calculated results, the necessary amount of hot coke was charged from Battery A at time T5–T6.

Calculation can be done so as to maximize the benefits of the hot coke quenching process in the same manner as shown in FIG. 4 using a simulation model.

The results of this example are shown in FIG. 8.

As is apparent from FIG. 8, according to the present invention even if trouble occurs during operation, the recovery of steam can be kept substantially constant and the level of coke within the prechamber can be always kept between prescribed upper and lower limits.

What we claim is:

1. A method of operating a dry quenching apparatus for hot coke wherein hot coke descends in a cooling chamber and is cooled by gas circulating through the cooling chamber and a heat exchanger comprising:

collecting data on preceding operations of the dry quenching apparatus by measuring (1) amount, temperature and pressure of steam recovered from a boiler of the heat exchanger; (2) amount, temperature and pressure of water supplied to the boiler; (3) temperatures of the circulating gas at an inlet and outlet of the boiler; (4) amount of recovered powdery coke; (5) amount of air blown in cooling chamber; (6) temperatures of the circulating gas at an inlet and outlet of the cooling chamber; and (7) temperature and amount of cooled coke discharged from the cooling chamber;

calculating a heat balance for a hot coke quenching system on the basis of the collected data on the preceding operations to determine a temperature of a charged hot coke and a composition and amount of combustible gases remaining in the charged hot coke when the hot coke is charged into the dry quenching apparatus;

calculating on the basis of the results of this calculation an optimal operating schedule including a blow rate of cooling gas, a water supply rate to the boiler, and a discharged rate of cooled coke;

calculating on the basis of the optimal operating schedule and running costs optimal operating conditions under which maximum benefits can be obtained, the optimal operating conditions including amount of hot coke to charge into the dry quenching apparatus; and operating the dry quenching apparatus in accordance with the optimal operating conditions.

2. A method of operating a dry quenching apparatus for hot coke as set forth in claim 1 wherein the calculation of heat balance is carried out in sequence from the heat exchanger to the coke dry quenching apparatus.

3. A method of operating a dry quenching apparatus for coke as set forth in claim 1 wherein a single dry quenching apparatus for hot coke is provided for one battery of coke ovens.

4. A method of operating a dry quenching apparatus for coke as set forth in claim 1 wherein a single dry quenching apparatus is provided for a plurality of batteries of coke ovens and hot coke is charged into the dry quenching apparatus from any one of said batteries.

5. A method of operating a hot coke dry quenching apparatus associated with a single battery of coke ovens in a production line comprising a plurality of batteries of coke ovens in series and a coke dry quenching apparatus, the method comprising, when trouble occurs with one of said batteries from which hot coke is being discharged, calculating a heat balance for a hot coke quenching system by calculating an amount of hot coke to be discharged from another one of said batteries of coke ovens and charged into a prechamber of the dry quenching apparatus based on the amount of coke in the prechamber and a discharge rate of cooled coke through a discharge device of the dry quenching apparatus so that a coke level in the dry quenching apparatus will not descend below a lower limit, and so that fluctuation in the discharge rate of cooled coke through the discharge device will be minimized, and charging the amount of hot coke from said another one of said batteries of coke ovens into the dry quenching apparatus.

6. A method of operating a dry quenching apparatus for hot coke as set forth in claim 5 wherein the calculation of the amount of hot coke charged from said another one of said batteries of coke ovens comprises:

collecting data on preceding operations of the dry quenching apparatus by measuring (1) amount, temperature and pressure of steam recovered from a boiler of the heat exchanger; (2) amount, temperature and pressure of water supplied to the boiler; (3) temperatures of the circulating gas at an inlet and outlet of the boiler; (4) amount of recovered powdery coke; (5) amount of air blown in the cooling chamber; (6) temperatures of the circulating gas at an inlet and outlet of the cooling chamber; and (7) temperature and amount of cooled coke discharged from the cooling chamber;

calculating the heat balance for the hot coke quenching system on the basis of the collected data on the preceding operations to determine a temperature of the charged hot coke and a composition and amount of combustible gases remaining in the charged hot coke when the hot coke is charged into the dry quenching apparatus;

calculating on the basis of the results of this calculation an optimal operating schedule including a blow rate of cooling gas, a water supply rate to the boiler, and a discharged rate of cooled coke; and calculating on the basis of the optimal operating schedule and running costs optimal operating conditions including the amount of hot coke to be charged from said another one of said batteries of coke ovens, under which maximum benefits can be obtained, the optimal operating conditions including amount of hot coke to charge into the dry quenching apparatus.

7. A method of operating a dry quenching apparatus for hot coke wherein hot coke descends in a cooling chamber and is cooled by gas circulating through the cooling chamber and a heat exchanger comprising:

collecting data on preceding operations of the dry quenching apparatus by measuring (1) amount, temperature and pressure of steam recovered from a boiler of the heat exchanger; (2) amount, temperature and pressure of water supplied to the boiler; (3) temperatures of the circulating gas at an inlet and outlet of the boiler; (4) amount of recovered powdery coke; (5) amount of air blown in the cooling chamber; (6) temperatures of the circulating gas at an inlet and outlet of the cooling chamber; and (7) temperature or amount of cooled coke discharged from the cooling chamber;

using the data collected in the data collecting step to determine a shift in heat balance of the dry quenching apparatus and the heat exchanger and determine (i) a temperature of the hot coke when the hot coke is charged into the dry quenching apparatus and (ii) a composition and amount of combustible gases remaining in the hot coke when the hot coke is charged into the dry quenching apparatus;

using the temperature, the composition and amount of combustible gasses to determine an optimal operating schedule of the dry quenching apparatus;

calculating on the basis of the optimal operating schedule optimal operating conditions including amount of hot coke to charge into the dry quenching apparatus; and operating the dry quenching apparatus in accordance with the optimal operating conditions.

8. The method of claim 7, wherein the hot coke is supplied to the dry quenching apparatus by a plurality of batteries of coke ovens, the method further including determining when trouble occurs with a first one of the coke batteries from which hot coke is being discharged, calculating an amount of hot coke to be discharged from a second one of the coke batteries and charged into a prechamber of the dry quenching apparatus based on an amount of coke in the prechamber of the dry quenching apparatus and a discharge rate of cooled coke through a discharge device of the dry quenching apparatus so that a coke level in the dry quenching apparatus will not descend below a lower limit, and so that fluctuation in the discharge rate of cooled coke through the discharge device will be minimized, and charging the amount of hot coke from said second one of said batteries of coke ovens into the dry quenching apparatus.

9. The method of claim 7, further comprising using the optimal operating schedule to automatically control at least one of (a) the amount of water supplied to the boiler of the heat exchanger; (b) the flow rate of the circulating gas in the cooling chamber; and (c) a rate at which hot coke is discharged from the dry quenching apparatus.

* * * * *